United States Patent [19]

Reed et al.

[11] 4,102,627

[45] Jul. 25, 1978

[54] DRAFT TELL-TALE FOR FIRED FURNACES

[75] Inventors: Robert D. Reed; Hershel E. Goodnight; Vern A. Street, all of Tulsa, Okla.

[73] Assignee: John Zink Company, Tulsa, Okla.

[21] Appl. No.: 730,167

[22] Filed: Oct. 7, 1976

[51] Int. Cl.[2] ..... F23N 3/00

[52] U.S. Cl. ..... 431/16; 431/19; 431/20; 236/15 C

[58] Field of Search ..... 431/19, 20, 13, 16; 236/15 C

[56] References Cited

U.S. PATENT DOCUMENTS

| | | | |
|---|---|---|---|
| 801,202 | 10/1905 | Barrus | 73/401 |
| 1,611,251 | 12/1926 | Smoot | 236/15 C |
| 2,223,837 | 12/1940 | Spitzglass | 236/15 C |
| 3,123,027 | 3/1964 | Livingston | 236/15 C |

FOREIGN PATENT DOCUMENTS

| | | | |
|---|---|---|---|
| 203,611 | 12/1956 | Austria | 236/15 C |

*Primary Examiner*—Carroll B. Dority, Jr.
*Attorney, Agent, or Firm*—Head, Johnson & Chafin

[57] ABSTRACT

In a fired furnace system having a convection section, and in which control a furnace draft is vital to both fuel conservation and avoidance of furnace damage, apparatus for monitoring the pressure conditions (draft) inside the furnace comprises a first pressure sensor means positioned at the arch (roof) of the furnace, a second pressure sensor means inside the furnace downstream from the convection section, and differential pressure measuring means connected between the first and second means for constantly measuring the pressure drop through the convection section. Alarm means are provided on the pressure drop measuring means to indicate increase or decrease in the pressure drop in the convection section, so that changes in burning conditions, which cause a greater pressure drop or less than normal, and which would result in either significant fuel loss or furnace damage or both if not immediately corrected, can through attention-requiring alarm, cause the required immediate correction to be made as fuel-firing conditions warrant adjustment of draft control means where the term "draft" is in reference to the condition of less-than-atmospheric pressure within the furnace.

6 Claims, 3 Drawing Figures

DRAFT TELL-TALE FOR FIRED FURNACES

CROSS-REFERENCE TO RELATED APPLICATION

This application is related to a co-pending application by two of the three co-inventors of this application Ser. No. 651,294 filed Jan. 22, 1976 entitled "Furnace Pressure Sensor".

BACKGROUND OF THE INVENTION

This invention lies in the field of fired furnace systems. More particularly this invention lies in the field of the detection of overpressure or underpressure inside a furnace due to changes in burning or operating conditions.

SUMMARY OF THE INVENTION

It is a primary object of this invention to provide a pressure sensing and alarm system that will continuously monitor the pressure drop in the convection section of a fired furnace, so that changes in operating conditions which will alter the pressure drop to a value where the pressure inside the furnace is above atmospheric pressure or too greatly below atmospheric pressure can be rapidly detected.

This and other objects are realized and the limitations of the prior art are overcome in this invention by measuring the pressure differential inside the furnace between the point downstream of the convection section and a point within the arch of the furnace. In a normal furnace, the negative pressure or draft at the arch of the furnace should be in the order of at least 0.03 inch of water column ("W.C."). If, because of flow conditions, a greater flow of air and combuation products through the convection section causes a greater pressure drop, then the draft inside the arch of the furnace will be reduced, and the pressure may actually become positive, which may cause considerable damage to the furnace. This situation is monitored by means of a differential pressure indicator which measures the pressure drop through or across the convection section, and when this value of pressure drop becomes greater by a selected amount above the normal pressure drop between the arch and the point downstream of the convection section, the alarm is created, so that appropriate correction measures can be taken and similarly if the pressure drop becomes less than a selected amount.

In addition, a draft gauge can be connected between the pressure sensor in the arch of the furnace and a piezometric sensor means distant from the furnace for measuring average atmospheric pressure. This will also indicate an overpressure condition in the furnace, but is not as indicative of the cause of the overpressure as would be the measurement of pressure drop across the convection section. Also it is not capable of creating alarm when overpressure exists.

BRIEF DESCRIPTION OF THE DRAWINGS

These and other objects and advantages of this invention and a better understanding of the principles and details of the invention would be evident from the following description taken in conjunction with the appended drawings in which.

DESCRIPTION OF THE PREFERRED EMBODIMENT

Figure 3:
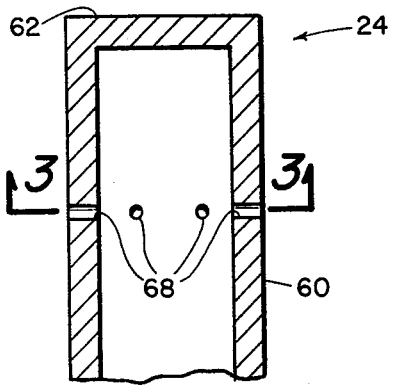
FIGS. 2 and 3 illustrate the details of a piezometric sensor for indicating average atmospheric pressure.
Figure 3:
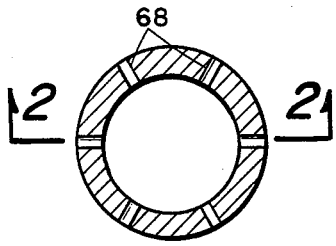

Referring back to the drawings, there is shown in schematic form and indicated generally by the numeral 10, a portion of a furnace system in which combustion air is delivered to the burner as a result of draft, or reduced pressure inside of the furnace. For normal operation, the pressure inside of the furnace should be measured at the roof, or arch, of the furnace and should be of the order of 0.03 inch WC.

Inside the convection section 15 of the furnace as indicated by numeral 14, would be a plurality of tubes or pipes containing fluid, for utilization of the heat content of the products of combustion, by convection between the hot gases and the pipes. Downstream of the convection section 15 is the stack 20, with a flow control means, such as damper 22 or other means.

Figure 2:
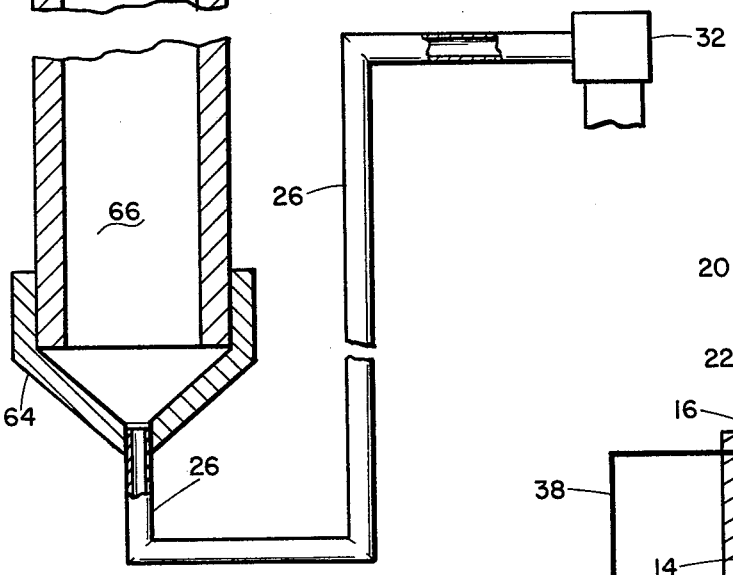
Figure 1:
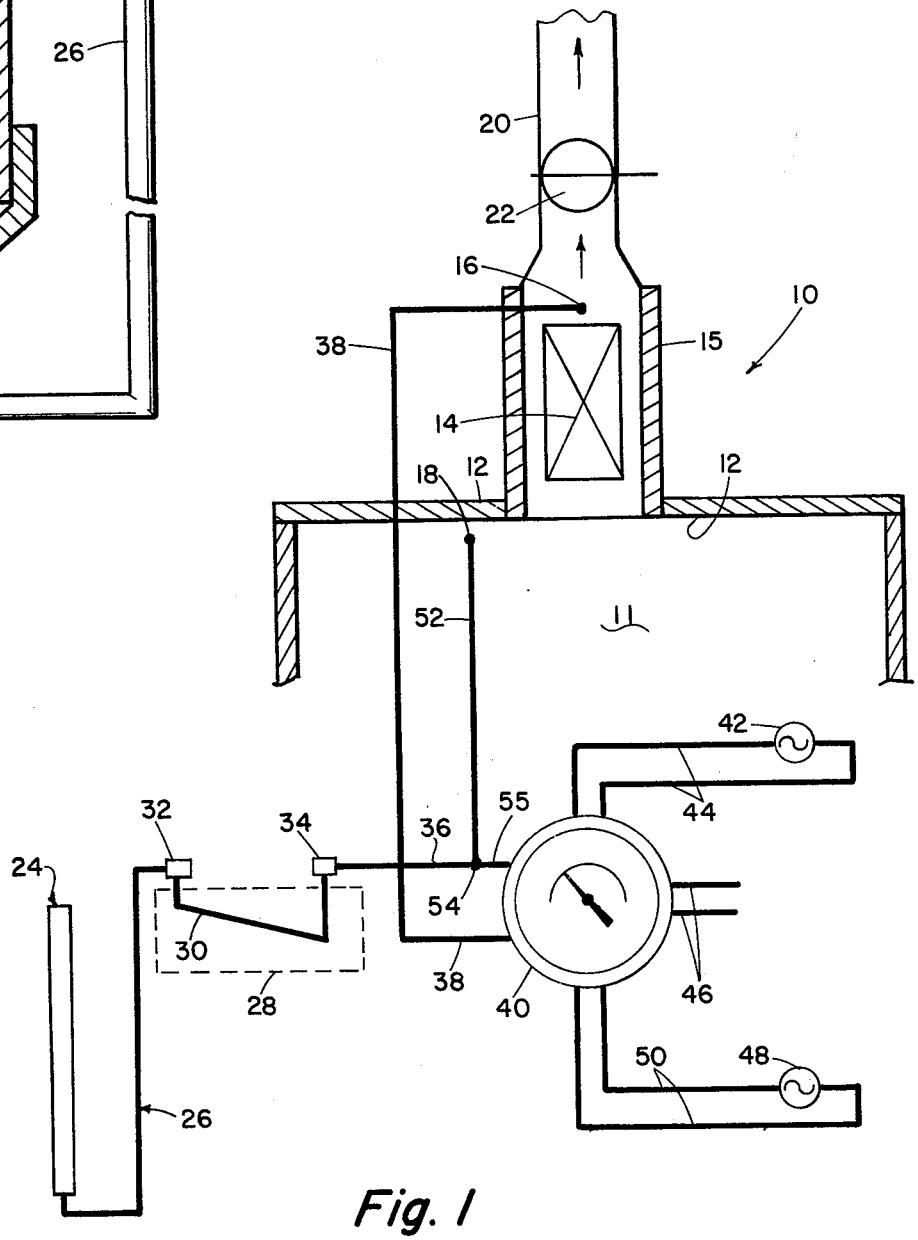
FIG. 1 illustrates an overall schematic diagram of the pressure measuring system inside of the furnace system.

A piezometric sensor means 24, which will be further described in connection with FIGS. 2 and 3 is positioned at some distance from the furnace, out in the open, where it is available to the prevailing winds. Because of its construction and because of the large volume of air inside of the sensor means, it provides an average value of atmospheric pressure, insensitive to sudden changes of pressure due to the effect of wind.

The piezometric pressure sensor means 24 is connected by a tubing or conduit 26 to a draft gauge 28 which is a manometer, having one sloping leg 30 so as to show with precision, small changes in level between the two arms of the manometer. The conduit 26 connects to the high pressure end 32 of the draft gauge 28, the low pressure end 34 of the draft gauge is connected by conduits 36 and 52 to a pressure sensor point 18, which measures the pressure P1 in the arch 12 of the furnace. This is just upstream of the convection section 15. There is another pressure sensor means 16 measuring a pressure P2 just downstream from the convection section 15. This is connected by tubing or conduit 38 to a differential pressure indicator and measuring means 40. A second inlet terminal of the pressure indicating means 40 is connected to junction 54 of the tubings 36 and 52, and to the pressure sensor 18. Thus the two inlet tubes 38 and 55 are connected respectively to the pressure sensors 16 and 18, measuring respectively the downstream pressure P2 and the upstream pressure P1.

Any suitable type of pressure sensor can be used at 16 and 18. However, because of the rapid flow of gas, a piezometer type of pressure sensor is particularly suitable.

In a normal furnace, the pressure P2 would normally be about 0.53 inch WC. The pressure P1 would normally be about 0.03 inch WC. The difference between P2 and P1 or approximately 0.5 inch WC is the pressure drop through the convection section, due to the flow of the gaseous products of combustion through the tortuous passages between the pipes in the convection section.

The draft at point P2 is set by the size and height of the stack, the temperature at the point 16, and the rate of flow of gases through the stack. Some control of this rate of flow is provided by the damper or control means 22.

Whenever the rate of flow of gases increases, the pressure drop due to the flow between points 18 and 16 will increase, and since the pressure P2 is relatively unchanged, the pressure in the furnace at the arch 12 will increase. If it increases as much as 0.03 inch WC then the pressure in the furnace at point 18 will be equal to atmospheric pressure, and will indicate a dangerous operating condition.

When the pressure drop increases, from P1 to P2, while P2 remains constant, the thing to do is slightly open the damper 22 for increase of draft at P2 to compensate for the increase in pressure drop from P1 to P2 for restoration of the draft of 0.03 inch WC at the arch or roof of the furnace, and alarm-notification of increased pressure drop from P1 to P2 assures prompt correction.

In this invention, the source of the monitoring signal is the pressure drop through the convection section, which is measured by the difference in pressure between P2 and P1, monitored by the pressure indicating instrument 40. This can be any one of a number of commercial instruments available on the market for the measurement of pressure differential and need not be described further. Such an instrument as 40 would have power supplied by means of leads 46 and would have a moving pointer system, to which can be attached alarm means. The pressure measuring apparatus 40 will have switch contacts arranged above and below a selected normal operating position of the indicating pointer. The positions of these switches can be changed. The object being that when the pressure differential is set at a normal value of 0.5 inch WC, that an overpressure of 0.03, or more, would indicate a potentially dangerous condition, and such a pressure increase would close a switch and create an alarm of overpressure. Similarly when the pressure decreases by a selected amount, a second set of switches not shown, but well known in the art of the pressure measuring instrumentation, would create a second alarm 48 connected to the pressure device 40 by means of leads 50.

Referring now to FIGS. 2 and 3, there is shown one form of piezometric pressure sensor that can be used to provide an average pressure in a region where there is fluctuation of velocity and direction of the gas flow. For example, the measurement of pressure in the atmospheric will indicate changes in atmospheric pressure whenever the wind blows over a structure. This is dependent on the direction and magnitude of the wind, and the type of structure. The device indicated generally by the numeral 24 is a cloased cavity, constructed of a pipe 60 with a closed end 62, and a plurality of small diameter openings 68 drilled through the wall and equally spaced circumferentially. These openings 68 may be of the order of 1/16 of an inch, for example, and there may be six or more. They should be small so that the effect of the wind will be minimized. The total area of the orifices 68 should be a small fraction of the inner area of 60 as it flows over the pipe 60. There is a cap 64 at the bottom end of the pipe 60, and tubing 26 that connects it to the terminal 32 of the draft gauge 28.

The piezometric pressure sensor 24 should be mounted at a distance from the furnace and should be set up at a height of about six feet, in a clear space free from large obstructions or buildings, such that the wind can blow over the pipe from various directions. Because of the large space 66 inside of the pipe, and because of the small rate of flow of air through the openings 68, as the wind pressure increases and decreases, as gusts of wind flow over the pipe, the pressure in the space 66 maintains an average value of atmospheric pressure. This is used as a reference to compare the pressure P1 at point 18, to atmospheric, by means of a draft gauge 28.

The measurement of pressure inside the furnace at points 18 and 16 can be made with any suitable pressure sensor. However, a piezometric device, like 60, is preferable, so that the fluctuations of gas flow over the devices due to the changing furnace conditions will not affect the reading of the sensors.

Also since the measurement of pressures at points 18 and 16 are in the inside of the furnace where there are temperatures of the order of 1200° or more, the construction of the pressure sensing devices should be of a metal which can resist these temperatures. Such a metal might be number 310 stainless steel, which contains 25% chromium and 20% nickel, for example.

The principal advantage of monitoring the pressure drop through the convection section, and thus measuring the draft inside the arch of the furnace, is not only to prevent an overpressure condition that will cause the emission of hot combustion gases through the leaks and cracks in the wall of the furnace, which if continued would overheat the metal parts and perhaps cause considerable damage to the structure. However, there is another advantage. If there is as large an opening as, say one square foot, in aggregate, through all of the cracks and leaks in the wall of the furnace, (and this is not unreasonable) then there would be, at overpressure conditions, a loss of a large amount of heat energy which would be carried out of the furnace by the flow of hot gases therefrom. This could constitute a serious loss of energy. And then there is the important advantage, in natural draft operation, of maintaining the proper draft of 0.3 inch WC at point 18, to provide the proper quantity of combustion air to provide efficient and complete combustion of the fuel.

The alarm device 40 should include means to sound an alarm when the pressure drop from P1 to P2 increases, and also when it decreases. A decrease in pressure drop is undesirable because unwarranted heat loss (fuel loss) results. The pressure drop from P1 to P2 is quite independent of the pressure which exists at P1 (static) because the pressure drop from P1 to P2 is due to gas flow quantity which includes the fuel fired and the amount of excess air, as well as the gas temperature. If the quantity of fuel fired is decreased, but the stack-induced pressure at P2 remains unchanged, there is decreased quantity of gas flowing across the convection section, and the pressure drop across the convection section decreases, while the draft at P2 remains unchanged. If the original pressure drop should be 0.50 inch WC and the fuel burned should be reduced 10%, the new pressure drop would be approximately 0.40 inch WC. This would increase the draft at P1 by 0.1 inch WC. This is because, with the original P2 at 0.53 inch WC to overcome the original pressure drop plus 0.03 inch WC, the new P1 would be 0.03 + 0.1 or 0.13 inch WC, and since, if the pressure (draft) inside the furnace is changed at one point, it changes equally at all other points internal of the furnace, the furnace draft at the burner level would also increase by 0.1 inch WC to cause the indraft of a greater quantity of air for the burners, while heat release (fuel burned) has been decreased by 10%. This would result in the presence of a much greater quantity of excess air for combustion which, in turn, causes excessive heat loss. The corrective procedure would involve closure of the stack damper 22 to reduce P2 to draft of 0.40 + 0.03 = 0.43 inch WC from the original 0.53 inch WC draft to still maintain draft at P1 of 0.03 inch WC and maintain conservation of fuel at a preferred condition.

It is therefore clear, that constant monitoring of the pressure drop across (through) the convection section is a valid means for avoiding furnace damage and excessive heat loss, where excessive heat loss translates to excessive fuel consumption. Either greater-than-normal or less-than-normal pressure drop can be considered as distinctly undesirable. However, unless the pressure drop monitoring is continuous, as well as automated, for pressure drop variation alarm, great furnace damage or great fuel loss can result before corrective procedure is taken, because the corrective action may occur hours after need for correction existed.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. In a fired furnace system in which combustion air is supplied to said furnace, said furnace having a roof, a convection section, a stack, and a stack flow control means, the improvement for monitoring the draft of said air inside the furnace comprising:

a. first pressure sensor means inside, at roof of said furnace, indicating the draft of said air P1 at that position;

b. second pressure sensor means inside said furnace downstream of the convection section, indicating the draft of said air P2 at that position;

c. differential pressure measuring means connected between said first and second pressure sensor means; and d. alarm means connected to said differential pressure measuring means, set at a selected value of pressure drop; and in which e. said first and second pressure sensor means each comprise a closed cavity contructed of a pipe closed at one end and having a plurality of substantially equally circumferentially spaced openings about the pipe near the closed end.

2. The furnace system as in claim 1 including a piezometric pressure sensor means at a position distant from said furnace for indicating average atmospheric pressure; and draft gauge means connected between said piezometric pressure sensor means and said first pressure sensor means.

3. The furnace system as in claim 1 including in said differential pressure measuring means, alarm means to indicate a selected value of draft less than a selected normal value.

4. The system as in claim 1 including in said differential pressure measuring means, alarm means to indicate a selected value of draft greater than a selected normal value.

5. In a fired furnace system in which combustion air is supplied by natural draft, said furnace having an arch, a convection section, a stack, and a stack flow control means;

the method of controlling said furnace system, comprising:

a. placing a first pressure sensor means inside, at the arch of said furnace indicating the draft P1 at said position;

b. placing a second pressure sensor means inside said furnace downstream of the convection section indicating a draft P2 at said position;

c. monitoring the differential pressure drop, P1 – P2, between said first and second pressure sensors; and d. when the rate of fuel consumption is reduced, whereby the flow of gases through said convection section is reduced, and the differential pressure drop P1 – P2 is reduced;

e. adjusting said stack flow control means to reduce the draft P2 at said second pressure sensor, by the amount that the differential pressure drop P1–P2 is reduced;

whereby the draft at P1 will remain constant and wherein said first and second sensor pressure means each comprise a closed cavity constructred of a pipe closed at one end and having a plurality of substantially equally circumferentially spaced openings about the pipe near the closed end.

6. In a fired furnace system in which combustion air is supplied to said furnace, said furnace having an arch or roof, a convection section, a stack, and a stack flow control means, and including:

first pressure sensor means inside, at the arch or roof of said furnace, indicating the draft P1 at that position;

second pressure sensor means inside said furnace downstream of the convection section, indicating the draft P2 of that position;

differential pressure measuring means connected between said first and second pressure sensor means and measuring P1–P2;

alarm means connected to said differential pressure measuring means, set at selected values of differential pressure rise and drop;

draft indicating means connected between a piezometric sensor measuring atmospheric pressure and P1; and whereby each of said pressure sensing means and draft indicating means comprises a closed cavity contructed of a pipe closed at one end and having a plurality of substantially equally circumferentially spaced openings about the pipe near the closed end;

the method of operating said furnace system, comprising the steps of:

a. adjusting said stack flow control means such that said P1–P2 equals nominal value P, and said draft indicating means indicates a draft at P1=0.03 inch W.C.;

b. responsive to change in P1–P2, as indicated by said differential pressure measuring means, readjusting said stack flow control means to bring P1–P2 to its nominal value P;

whereby said draft indicating means will indicate a draft of 0.03 inch W.C.

* * * * *